United States Patent [19]

Bredow et al.

[11] Patent Number: 4,624,165

[45] Date of Patent: Nov. 25, 1986

[54] POWER TOOL, PARTICULARLY REVOLVING CUTTING PRESS WITH TOOL RECEIVING MEANS SUITABLE FOR A REMOTEDLY CONTROLLED EXCHANGE

[75] Inventors: Walter Bredow; Albert Schwarze, both of Alfeld, Fed. Rep. of Germany

[73] Assignee: C. Behrens AG, Alfeld, Fed. Rep. of Germany

[21] Appl. No.: 653,918

[22] Filed: Sep. 24, 1984

[30] Foreign Application Priority Data

Sep. 29, 1983 [DE] Fed. Rep. of Germany ..... 3335329

[51] Int. Cl.[4] ..... B26D 7/26; B26F 1/14

[52] U.S. Cl. ..... 83/685; 83/686; 83/690; 83/698

[58] Field of Search ..... 83/552, 655, 685–687, 83/690, 698; 29/568; 279/1 K; 408/72 B; 72/465, 462, 481, 444

[56] References Cited

U.S. PATENT DOCUMENTS

| | | | |
|---|---|---|---|
| 3,229,791 | 1/1966 | Soman | 83/698 |
| 3,238,832 | 3/1966 | Williamson | 83/698 |
| 3,296,905 | 1/1967 | Killaly | 83/698 |
| 3,610,021 | 10/1971 | Hopper | 83/698 |
| 3,638,473 | 2/1972 | McElroy | 72/462 |
| 3,719,117 | 3/1973 | Mauk et al. | 83/698 |

FOREIGN PATENT DOCUMENTS

| | | | |
|---|---|---|---|
| 1446708 | 8/1978 | United Kingdom | 83/698 |

*Primary Examiner*—Frank T. Yost
*Assistant Examiner*—Hien H. Phan
*Attorney, Agent, or Firm*—Michael J. Striker

[57] ABSTRACT

In a power tool, particular a revolving cutting press, a punch holder and a stripper shoe are provided with openings for a punch and a stripper, whereas a matrix shoe which carries a matrix is located in a lower revolving plate also in a recess open in direction of withdrawal or insertion of the matrix, and these tools are secured from their unintentional withdrawal by elements which are releasable by the machine so that withdrawal and insertion of the complete tool sets can be performed without manual operations.

19 Claims, 13 Drawing Figures

6
47

6
48

6
49

6
28
28
30
30
1
22
94
36
23
27
36
93
33
40
40
41
94
33
31
41
40
26
26
39
21
36
94
2

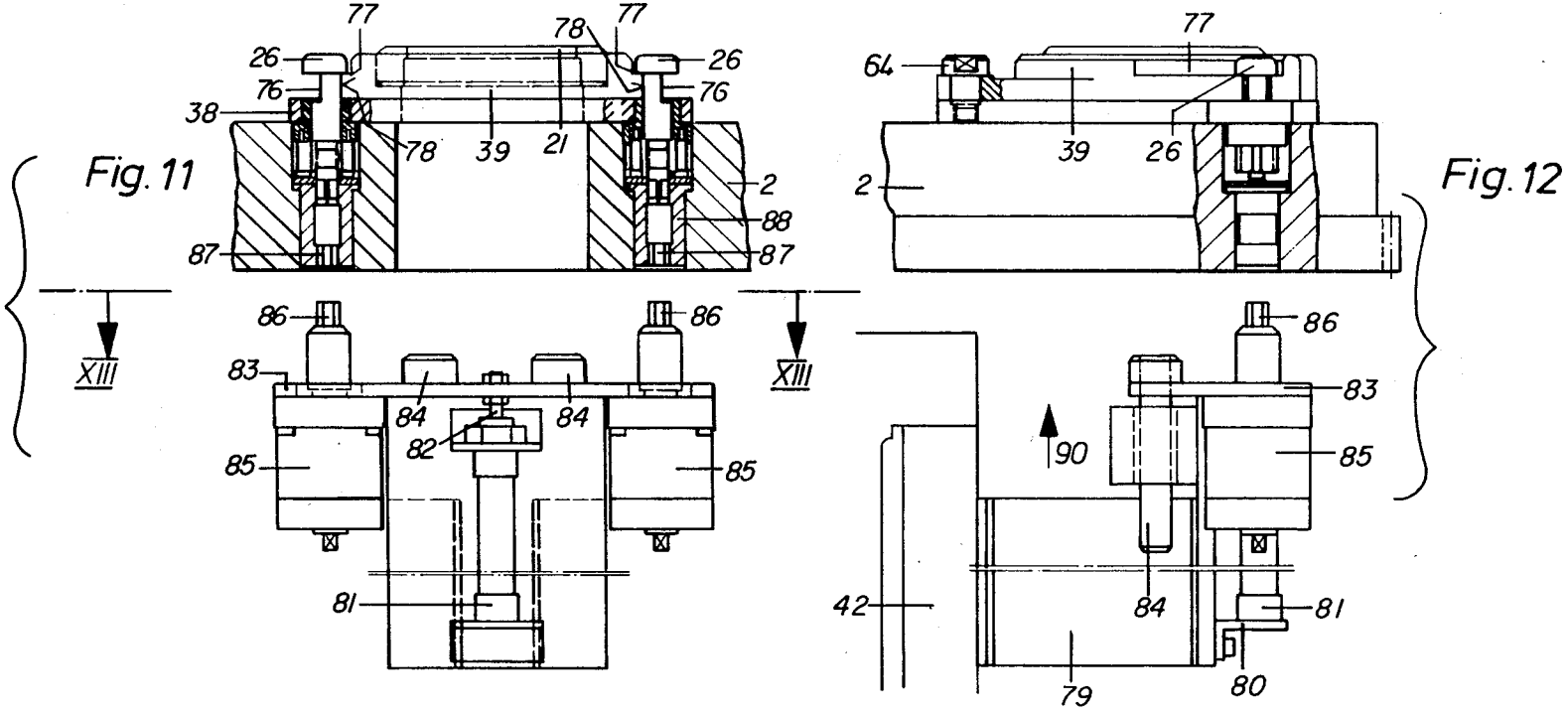
Fig. 12
Fig. 11
XIII
XIII
2
26
77
39
64
86
83
85
81
80
84
79
90
42
88
87
76
78
21
38
82
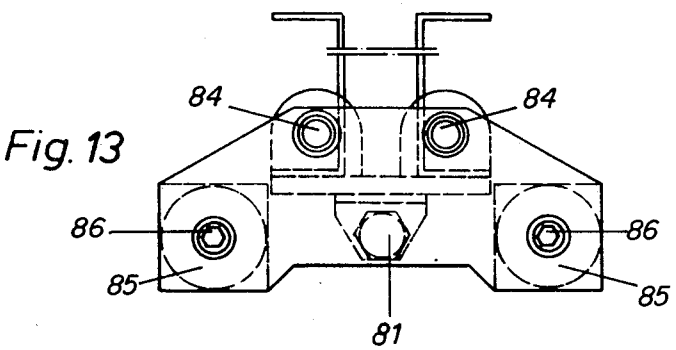
Fig. 13
86
85
84
81

POWER TOOL, PARTICULARLY REVOLVING CUTTING PRESS WITH TOOL RECEIVING MEANS SUITABLE FOR A REMOTEDLY CONTROLLED EXCHANGE

BACKGROUND OF THE INVENTION

The present invention relates to a power tool, and particularly to a revolving cutting press with tool receiving means suitable for a remotedly-controlled exchange.

In the revolving cutting presses it is known to insert the individual tool sets in openings distributed along the periphery of the revolving plates arranged one above the other. The tool sets are composed of at least a punch, a matrix and a stripper. Depending upon the type of the mounting of the tools on the revolving plates, a manual conversion is required, or in other words, the withdrawal of complete tool sets as well as their replacement by other tool sets is connected with a plurality of manual works and therefore with a high labor consumption. Therefore, there is a need to improve mounting of the tools on the revolving plates in the sense of shortening of the conversion time.

The German patent application No. P 3,331,667.8 discloses a power tool in which the stripper is mounted in a stripper shoe having a groove which extends substantially in the radial direction of the revolving plate and is open to its periphery, whereas its lateral region is shaped so that in connection with the lateral edges of the stripper, the latter is fixed in a vertical direction. The stripper is secured from an unintentional radial withdrawal in this groove by a spring-loaded catch. Simultaneously, the matrix is supported in this known revolving cutting press in a matrix shoe mounted on the lower revolving plate. The matrix shoe has a U-shaped recess which is open in a radial direction and receives the matrix. The matrix in inserted condition in the U-shaped recess is fixed by two spring-loaded clamping levers which engage the matrix laterally. With the aid of an exchange device which releases both the catch and the clamping levers, both the stripper and the matrix can be withdrawn from the revolving plates. The tool receiving means known from this patent application is not suitable for simultaneous exchange of the punch. Moreover, in this known exchange device all devices which serve for releasing the locking elements for mounting the tool move simultaneously with the exchange device.

SUMMARY OF THE INVENTION

Accordingly, it is an object of the present invention to provide a power tool, particularly a revolving cutting press, with a remotedly controlled exchange of tool receiving means in which a complete tool set composed at least of a punch, a stripper and a matrix can be withdrawn in a simple manner from the revolving plates and replaced by another tool set, so that such a revolving cutting press is especially suitable for a computer-controlled tool exchange.

In keeping with these objects and with others which will become apparent hereinafter, one feature of the present invention resides, briefly stated, in a power tool in which a punch is arranged with the aid of a locking element in a receiving device which is open in direction of insertion and withdrawal of the punch, and for releasing or arresting the working elements of the punch, the stripper, and the matrix individually switchable actuating devices are provided, for example mounted on a machine frame of the revolving cutting press.

It is especially important in this construction that also the punch is arranged in a receiving device which is open for example in the radial direction and formed for example as a groove which supports the punch in the vertical direction. For fixing the punch during its insertion into this groove in a definite end position, an abutment is advantageously provided. All tools of one tool set are fixed by special locking elements in the associated receiving devices, wherein the working elements can be released in accordance with the present invention by actuating devices located on the machine frame of the revolving press. It is advantageous that the functions of tool exchange device adapted to this revolving cutting press can be limited to the engagement of the tools to be exchanged, since the functions of releasing of the working devices can be performed by special devices mounted on the revolving cutting press. A tool exchange device can be designed in this way in an especially simple manner, so that the integration of the thus designed revolving cutting press in computer controlled manufacture is simplified.

In accordance with another feature of the present invention the receiving device cooperating with the punch is formed as a punch holder with a lower region facing toward the punch and provided with a groove to form lockingly secure the punch relatively to its working direction. This provides for the advantage that the operational element which is available as a receiving device for the punch, namely the punch holder, has the groove which forms the form-locking securing means for the punch relative to its working direction which is substantially the vertical direction, and the groove can have a plurality of shapes such as dove-tail shape, rectangular shape with an undercut, etc. With the use of such known functional element as the punch holder to serve as the receiving device, a structural adaptation for forming the inventive tool receiving means is reduced.

In accordance with yet another feature of the present invention, the locking element cooperating with the punch is composed of at least one centering pin which is bringeable in engagement with an opening in the punch and guided in the receiving device of the punch, for example, in an opening of the punch holder. The centering pin can be insertable into the opening of the punch for locking the latter via an entraining piece which is guided inside the punch holder and with the aid of a holding screw arranged at a distance from the centering piece and screwable into a threaded opening of the punch. These features provide for an especially simple arresting possibility for the punch. Constructively, there are a plurality of possibilities. With essential structural elements such as the holding screw, the receiving piece, and the centering pin, and with screwing-in of the holding screw the centering pin is introduced into the associated opening of the punch and during screwing out of the holding screw it is withdrawn from the opening of the punch. A spring is arranged between the punch holder and a flange provided on the centering pin, and the flange abuts against one side of the entraining piece so that with this screwed-in holding screw via the entraining piece and the flange, the centering pin is inserted into the opening of the punch with compression of this spring.

These features provide for an example of how the movement of the holding screw and centering pin is performed via the entraining piece with cooperation of the springs which influence the entraining piece during the withdrawal of the holding screw from the threaded opening of he punch, so that as a result the locking action applied by the entraining piece via the flange onto the centering pin is removed and the latter can be displaced under the action of the associated spring.

In accordance with still a further feature of the present invention the holding screw is provided with a head which forms a coupling element for the respective actuating device. The actuating device has here the function of withdrawing the holding screw from the associated threaded opening of the punch, so that the head can be provided for example with an inner hexagon or an inner square in which the respectively shaped counter piece of the actuating device can be inserted.

In accordance with further features of the present invention, the locking element cooperating with the matrix includes a safety pin and two clamping pins, wherein the clamping pins are arranged at both sides relative to the direction of insertion or withdrawal of the matrix and are movable for forming a form-locking connection with the matrix, advantageously rotatable about their longitudinal axes. The form-locking connection is formed so that the matrix both relative to the direction of its withdrawal and insertion and in a direction normal to the direction as fixed, whereas the safety pin forms an abutment point. With these features the matrix or the matrix carrying matrix shoe are displaceable for example radially on the upper side of the lower revolving plate and abut against a safety pin so that by the position of the safety pin the matrix obtains an exactly defined radial position relative to the revolving plate. For exact guidanee, the connection between the safety pin and the matrix or the matrix shoe can be formed so that the safety pin in the end position of the matrix is located in a semi-circular recess of the matrix or the matrix shoe which is open toward the center point of the revolving plate so that an exact fixation is possible. Simultaneously, the matrix or the matrix shoe can be insignificantly overlapped by a head of this safety pin so as to provide simultaneously a vertical securing at this location. Both clamping pins arranged laterally over the matrix can basically have any construction, however, their form-locking connection with the matrix or the matrix shoe must be releasable by a simple movement. The matrix is arrested in this manner in three points, and with the respective construction of the clamping pins they can simultaneously perform securing functions in a vertical direction.

Another feature of the present invention is that the clamping pins at their upper end facing toward the matrix under their head are provided with a recess, so that the cross-section of the clamping pins in the region of this recess has the shape of a circular segment and its round portion in the arresting position of the clamping pins is in engagement with the re-spective recesses of the matrix or the matrix shoe, whereas in the open position of the clamping pins their round portion is located at the opposite end of the recesses and no engagement between the clamping pins and these recesses takes place. These features provide for the advantage that for obtaining the arresting function of the clamping pins they must be rotated by an angle of approximately 180° . Because of this the construction of the respective actuating device providing this releasing movement is simplified.

The clamping pins and their end facing away from the matrix can be arranged in connection with a structural element which forms a coupling element for the actuating device. This structural element performs a coupling function between the clamping pins and the actuating device and can have any construction. Here also the arrangement of an inner hexagon or an inner square in cooperation with a respective counterpiece on the actuating device is possible.

The punch, the stripper and the matrix or the matrix shoe can be provided with two pairs of openings arranged at a distance from one another and extending in direction of withdrawal or insertion of these tools. Additional openings extend through the first mentioned openings in their end region, and a pin can be inserted in the additional openings so that the pin partially extends into the first mentioned openings and the further openings are located at a certain distance from the outer limiting surface of the respective tool. With these features the structural expenses for handling of the individual tools of a tool set can be retained small. The openings which are not provided with a pin perform a vertical supporting function, whereas the openings provided with a pin form both a supporting function and a securing function. A tool exchange device corresponding to these tools can be characterized for example by three pin pairs movable in direction toward the tools. These pins which must be inserted in the openings prvided with the first mentioned pins must have a respective shape so as to provide via the first mentioned pins a form locking fixation of the tools.

The novel features which are considered as characteristic for the invention are set forth in particular in the appended claims. The invention itself, however, both as to its construction and its method of operation, together with addi-tional objects and advantages thereof, will be best understood from the following description of specific embodiments when read in connection with the accompanying drawings.

BRIEF DESCRIPTION OF THE DRAWING

FIG. 11 is a schematic view of an actuating device associated with the matrix;

FIG. 12 is a side view of the actuating device of FIG. 11; and

FIG. 13 is an elevational view in a plane XIII—XIII in FIG. 11.

DESCRIPTION OF PREFERRED EMBODIMENTS

Figure 1:
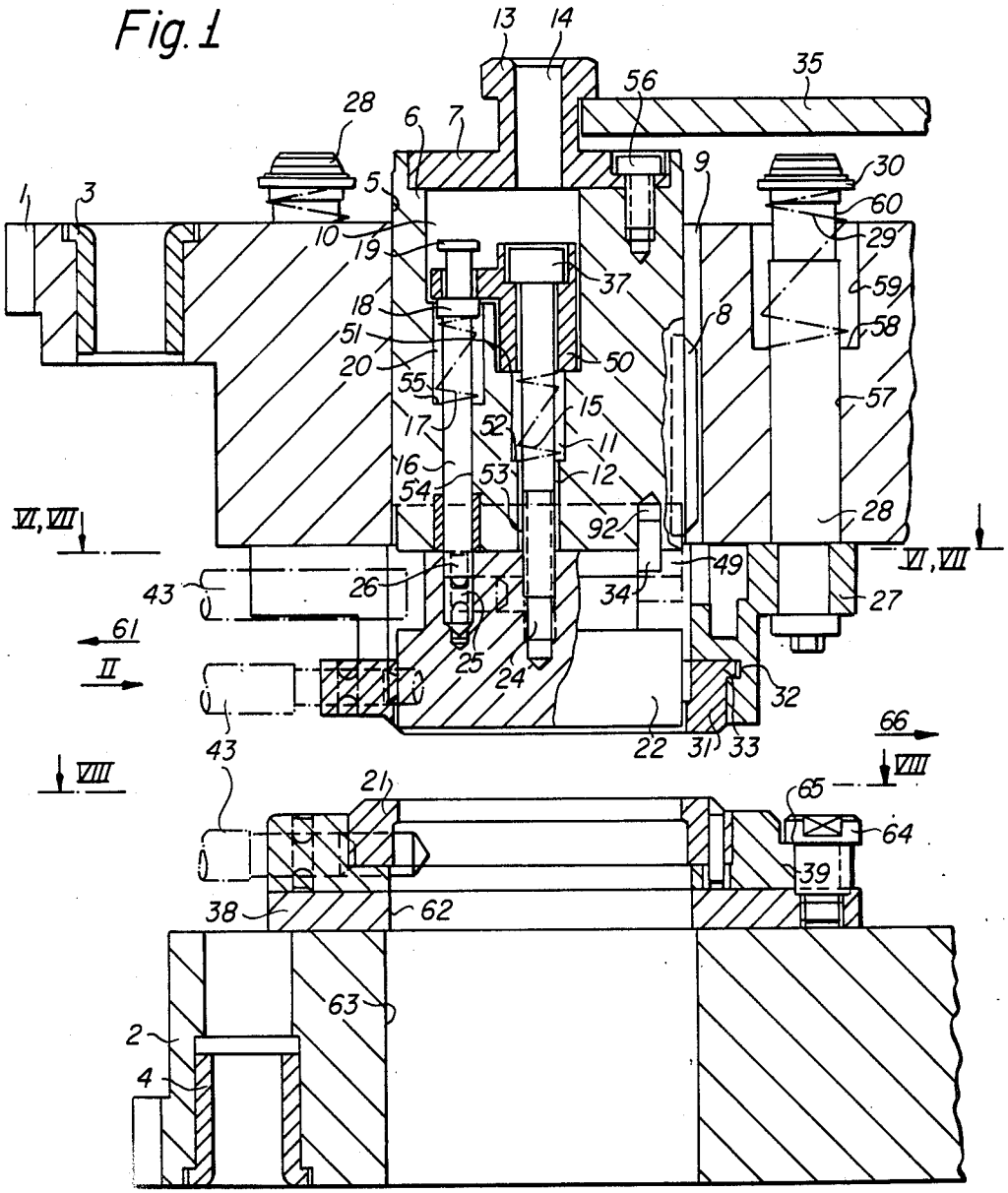
FIG. 1 is a vertical section through a revolving plate of a revolving cutting press in accordance with the present invention.

In FIG. 1 upper and lower revolving plates of a not shown revolving cutting press are identified with reference numerals 1 and 2. The revolving plates 1 and 2 are rotatable about a vertical axis and carry at their periphery arresting bushes 3 and 4 with which the revolving plates can be fixed in predetermined rotary angular position, for example, a punching position. This fixation can be performed for example by a pneumatically actuated not shown here arresting pin which is inserted in this arresting bush.

The upper revolving plate 1 is provided with a row of openings 5 arranged on its periphery, and a punch holder 6 is slidingly guided in each of the openings 5. A key 8 which is guided in a goove 9 of the opening 5 guarantees a rotation-free seating of the punch holder 6.

The punch holder 6 ends in its upper region in a head plate 7 which is provided with a central opening 14 extending in the longitudinal direction the punch holder. A coupling pin 13 extends from the plane of the head plate 7, and the opening 14 is formed in this coupling pin. In the inoperative position shown in FIG. 1, the punch holder 6 is vertically secured by a punch holder plate 35 in the shown position so that the coupling pin abuts against the edge of the punch holding plate.

In the operative position the coupling pin 13 is coupled with a not shown machine pusher which moves the punch holder 6 for performing punching works in a vertical direction.

On the punch holder 6 and particularly on its end facing away of the coupling pin 13, a punch 22 is screwed substantially through a centrally arranged holding screw 12. A head 37 of the holding screw 12 provided with an inner hexagon, is supported via an entraining piece 50 on a circular ring-shaped pressing surface 51. The holding screw further extends in an opening 11 which transits at a location 52 into an opening 53 of a smaller diameter. A threaded opening 24 is connected with the latter and extends in the punch 22. A spring 15 is supported on the circular ring surface of the punch holder 6 produced at the location 52. The spring 15 has an end which faces away from the location 52, and presses against the lower side of the entraining piece 50. The spring 15 in the shown mounting position is under tension.

A centering pin 16 is located laterally near the holding screw 12 and extends in the mounted condition through an opening 54 formed in the punch holder 6 and into an opening 25 located in the punch 22. The opening 54 transits at a location 55 into an opening 20 of a greater diameter. The centering pin 16 has at its upper end two flanges arranged at a distance from one another and located respectively below and above the entraining piece 50. In the assembled position shown in FIG. 1 the lower flange 18 is pressed against a lower side of the entraining piece 50 by a spring 17 which abuts at its one side against a circular ring surface at the location 55 and at its other side against the flange 18. The upper flange 19 is located in this assembling position at a distance over the upper side of the entraining piece 50 facing to this flange. Both the head 37 of the holding screw 12 and the centering pin 16 with its upper flange 19 extend in a recess 10 of the punch holder 6 which is substantially overlapped by the head plate 7. The head plate 7 is mounted on the punch holder 5 by screws 56. The form-locking arresting of the punch 22 on the punch holder 6 will be explained hereinbelow.

A stripper shoe 27 is held on the lower side of the revolving plate 1 by stripper pins 28, and the stripper pins extend through openings 57 of the upper revolving plate 1. The openings 57 transit at a location 58 into openings 59 of a greater diameter. The upper end of the stripper pin 28 forms a flange 30. In the shown inoperative position the stripping pin is held by a spring element 60 which at its one end is supported on a circular ring surface produced at the location 58 and at its other end is supported on the lower side of the flange 30. The stripper pin 28 is slidingly guided in the openings 57 and can be actuated by a not shown plunger so as to move the stripper shoe 27 for performing punching works.

The stripper shoe 27 has a U-shaped opening which is open in direction of the arrow 61. The stripper 31 is inserted in this opening and secured in form-locking manner by a circular groove 32 in which a flange 33 of the stripper engages. A further position securing of the stripper 31 will be explained hereinbelow. It is important that both the punch 22 and the stripper 31 are withdrawable from or insertable into the revolving plate 1 in the direction of the arrow 61 or in the opposite direction.

The lower revolving plate 2 carries a mounting plate 38 which is fixed on this plate for example by not shown screws. The mounting plate 38 is provided with a central opening 62 which serves for the punching process. The opening 62 is in alignment with an opening 63 in the lower revolving plate 2 and carries at its end facing away from the outer peripheral surface of the revolving plate 2 a safety pin 64 screwed in the mounting plate 38. The safety pin 64 serves for radially supporting a matrix shoe 39 relative to the revolving plate 2. The matrix shoe 39 is provided at this location with a flattening 65 which can be recognized from a U-shaped recess open in direction of the arrow 66. This U-shaped recess engages a flange of the safety pin 64. Further safety and mounting elements of the matrix shoe 39 will be discussed later on. The matrix shoe 39 carries a matrix 21.

Figures 2, 3, 4, 5:
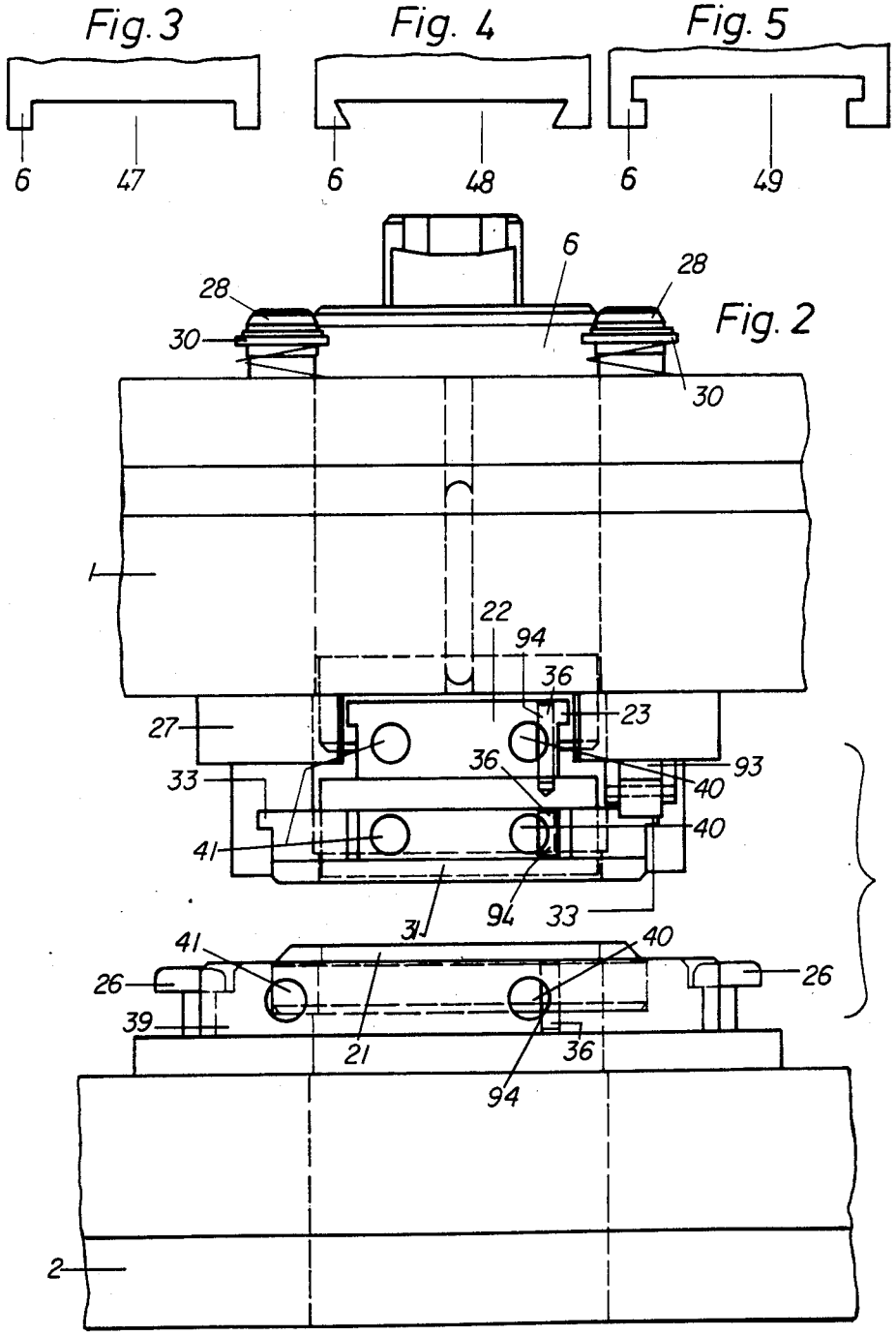
FIG. 2 is an elevational view of the inventive revolving cutting press in direction of the arrow II in FIG. 1.
FIGS 3–5 are views showing various shapes of grooves formed in a punch holder.

In FIG. 2 and other Figures elements which correspond to the elements of FIG. 1 are identified with the same reference numerals to prevent repetitions.

FIG. 2 shows an elevation view of the tool set of a revolving cutting press from the direction in which an exchange of this tool set is performed. The tool set includes the punch 22, the stripper 31, and the matrix shoe 39 with the matrix 21 held in the latter. It can be seen that the punch 22 in the shown direction is provided at both sides with a flange 23 which is held in a respective groove of the punch holder 6 extending normally to the plane of the drawing of FIG. 2, so that the punch 22 in this manner is secured in a vertical direction in form-locking manner. The punch 22 has its radial abutment inside the punch holder in a pin 34 (FIG. 1) which is inserted in an opening 92 parallel to the holding screw 12.

It can be seen that the flange 33 which extends at both sides of the stripper is supported in the respective groove of the stripper shoe 27 so that withdrawal of the stripper 31 normal to the plane of the drawing in FIG. 2 is possible. Securing against an unintentional withdrawal of the stripper 31 is performed by a spring-loaded catch 93.

The matrix shoe 39 is secured against an unintentional withdrawal normal to the plane of the drawing in FIG. 2 by clamping pins 26 arranged at both sides. The construction and operation of these clamping pins 26 will be explained hereinbelow.

The punch 22, the stripper 31 and the matrix shoe 39 are provided with two openings 40 and 41 arranged one near the other and extending substantially horizontally. Further openings 36 of smaller diameter partially pass through the openings 40 arranged one above the other in their right end region. Pins 94 are inserted in the openings 36 and extend partially into the openings 40 as shown in the projection in FIG. 2. The importance of these pins 94 within the present invention will be explained later on.

FIGS. 3, 4 and 5 show different constructions of the lower region of the punch holder 6, which serves for guiding the punch 22. In FIG. 3 a rectangular groove 47 is provided which does not allow any vertical fixation of the punch. FIG. 4 shows a dove-tail-shaped groove 48, and FIG. 5 shows a rectangular groove 49 forming an undercut. The constructions of FIGS. 4 and 5 provide for a vertical fixation of the punch 22. The above-mentioned rectangular groove with undercut is schematically shown in FIG. 1 and identified with reference numeral 49.

Figure 6:
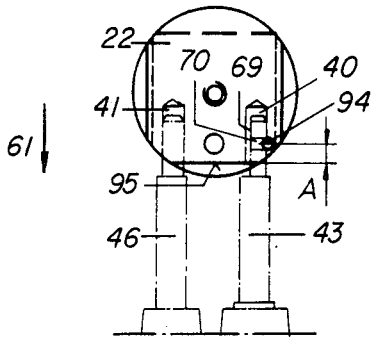
FIG. 6 is an elevational view of a punch in a plane corresponding to VI—VI in FIG. 1.
Figure 7:
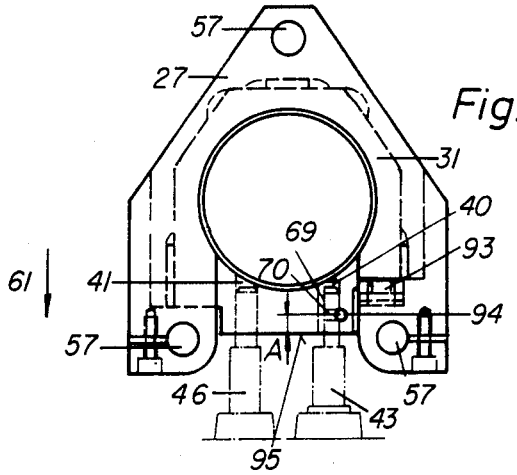
FIG. 7 is an elevational view of a stripper shoe in a plane VII—VII in FIG. 1.
Figure 8:
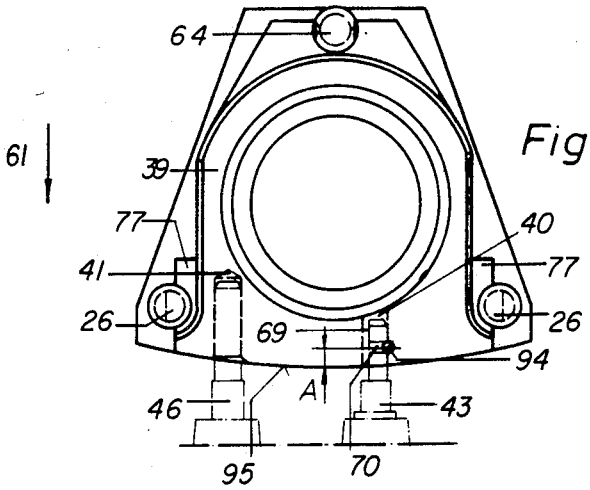
FIG. 8 is an elevational view of a matrix shoe in a plane VIII—VIII FIG. 1.

FIGS. 6, 7 and 8 serve for explanation of the operation of the openings 40 and 41. While the openings 41 serve for receiving a withdrawing pin not-rotatably supported on a not shown tool exchange arrangement, a withdrawing pin 43 supported on this tool exchange arrangement rotatably about its longitudinal axis, can be inserted into the openings 40. The withdrawing pin 43 is characterized by a flattening 69 provided in its region insertable into the opening 40 and having a cross-section formed as a circular segment. A locking groove 70 is formed in the round part of this cross-section and has a radius in the cross-section, corresponding to the radius of the pin 94. During insertion of the withdrawing pin 43 into the openings 40, it is located in a rotary angular position in which the flattening 69 is located at the side facing toward the pins 94. It can be recognized that in this rotary angular position easy insertion of the withdrawing pin 43 into the openings 40 is possible. Subsequently, the withdrawing pin 43 is rotated by 180° so that the working groove 17 is brought in a form-locking engagement with the pins 94. In this manner the punch 22, the stripper 31 and the matrix shoe 39 are form-lockingly fixed on the not shown tool exchange arrangement and can in this manner be withdrawn from the holders associated therewith. It is important for these holders that, as shown for example in FIGS. 7 and 8, they are U-shaped, or in other words, open in direction of the arrow 61, so that a removal of the punch 22, the stripper 31 and the matrix shoe 39 in this direction or an insertion in the direction opposite to the arrow 61 is possible in a purely mechanical way.

Figure 9:
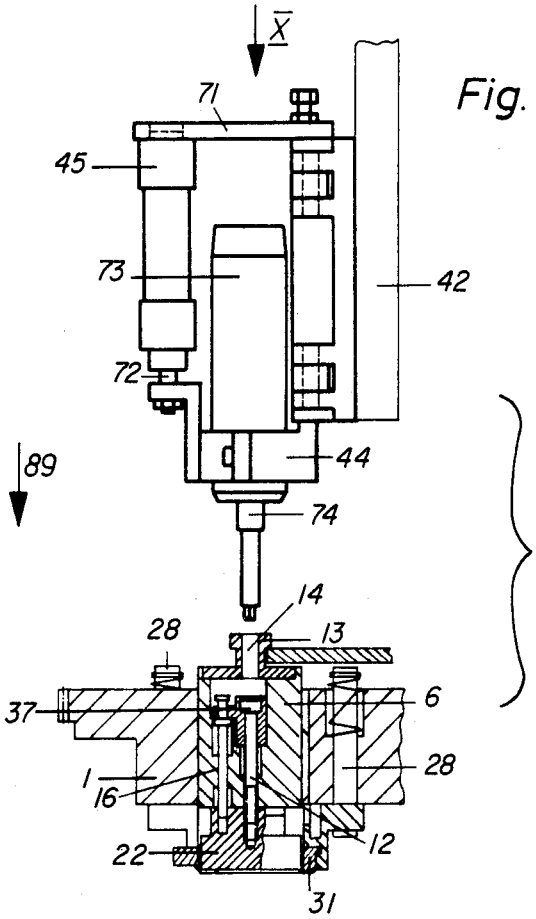
FIG. 9 is a view schematically showing an actuating device associated with the punch.
Figure 10:
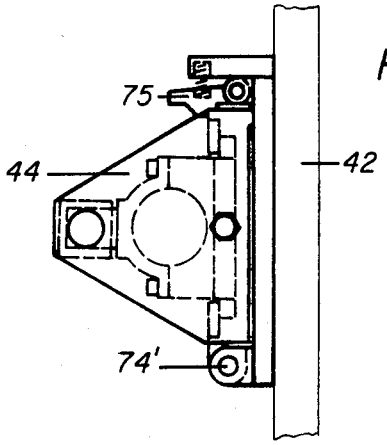
FIG. 10 is a plan view in direction of the arrow X in FIG. 9.

FIGS. 9 and 10 show a mechanism with which mounting of the punch 22, and the stripper 31 on the upper revolving plate 1 can be performed in a mechanical way. For this purpose a vertically movable carriage 44 is arranged on a machine frame 42 of the revolving cutting press, and a double-acting cylinder-piston unit 45 can move the carriage 44. The cylinder of the cylinder-piston unit 45 is fixed for this purpose on the machine frame 42 via a mounting plate 71, whereas a piston rod 72 is connected with the carriage 44. A mechanical screwing tool 73 is mounted on the carriage 44 and has a screw spindle 74 provided with an outer hexagon. The screw spindle 74 extends through the opening 14 of the coupling pin and can be inserted into the head 37 of the holding screw 12.

As can be seen from FIG. 10, the carriage 44 is supported on the machine frame 42 turnably about a vertically extending axle 74', so that when needed for maintenance purposes the complete punch holder 6 can be withdrawn from the revolving plate 1 upwardly. In the operative position which is not shown in the drawing, the carriage 44 is secured by a schematically shown catch 75.

FIG. 8–11 illustrate the construction and operation of the clamping pins 26:

The clamping pin 26 is provided under its head with a recess 76 formed as a flattening of the circular shaft of the clamping pin. The matrix shoe 39 has flattenings provided at locations 77 and having semi-circular recesses 78. The radius of these semi-circular recesses 78 substantially corresponds to the radius of the shaft of the clamping pin 26 in this region. When the clamping pin 26 is located relative to its longitudinal axis in a rotary angular position in which the round portion of the cross-section engages in the respective semi-circular recess 78, the matrix shoe 39 is form-lockingly secured as to its movement normally to the drawing plane of FIG. 11. The depth of the recess 76 radial to the shaft of the clamping pin 26 is dimensioned so that after the rotation of the clamping pin 26 by 180° relative to the position shown in FIG. 11, the recesses 76 faces toward the respective recess 78 and in this position the matrix shoe 39 is no longer arrested by the clamping pin 26.

FIGS. 11, 12 and 13 show a mechanism with which the form-locking arresting by the clamping pins 26 is performed in a mechanical way.

For this purpose, an arm 79 is mounted on the machine frame 42 under the lower revolving plate 2 and supports on an angular support 80 and advantageously double-acting cylinder-piston unit 81. A mounting plate 83 is mounted on a piston rod 82 of this cylinder-piston unit and is movable along two stationary vertical guiding pins 84. The mounting plate 23 carries two rotary aggregates 85 at a distance from one another and in a position which enables coupling pins 86 connected with output shafts of the rotary aggregate to be inserted in shaped depressions 87 of a structural part 88 which is connected with the clamping pin 26 in a rotary-fixed manner.

The operation of the inventive tool-receiving device which can be easily understood from the drawing is shortly explained as follows:

It is assumed that simultaneously a complete tool set including the punch 22, the stripper 31 and the matrix shoe 39 with the matrix 21 arranged therein must be exchanged.

After the revolving plate is fixed by the arresting bushes 3 and 4 in predetermined position serving for the tool exchange, the carriage 44 is moved vertically in direction of the arrow 89 (FIG. 9) by the actuation of the cylinder-piston unit 45, so that the screw spindle 74 and particularly its end region provided with the outer hexagon is brought through the opening 14 of the coupling pin 13 in engagement with the inner hexagon of the head 37 of the holding screw 12. Simultaneously by the actuation of the cylinder-piston unit 81, the mounting plate 83 is moved upwardly in direction of the arrow 90 (FIG. 12) so that the coupling pins 86 are coupled with the shaped depressions 87.

By actuating of the screwing tool 73 the holding screw 12 is released and after complete withdrawal from the threaded opening 24 are lifted by the releasing spring 15 which presses against the lower side of the entraining piece 50. This lifting is attained so that the entraining piece 50 acts on the head 37 which is held in a form-locking manner in the same.

The lifting of the entraining piece 50 results in that the centering pin 16 can also be lifted under the action of the releasing spring 17, and after this the lower flange 18 no . longer abuts against the lower side of the entraining piece 50. In this manner the centering pin is fully withdrawn from the opening 25 of the punch 20 so that the arresting of the punch is terminated.

By the rotary aggregate 85 the clamping pin 26 is now rotates by 180° so that the recesses 76 of the clamping pin 26 are no longer located at the side facing the recesses 78 of the matrix shoe 39 and the arresting provided by the clamping pin 26 is terminated.

It should be mentioned that prior to the withdrawing of the stripper 31 its arresting by the catch 93 must be removed which can be performed with a tool exchange arrangement in a simple manner simultaneously during the actuation of the rotary aggregate 85 and the screwing tool 73.

Subsequently, the withdrawing pin 43, 46 of a tool exchange arrangement are inserted in the associated openings 40 and 41. The withdrawing pin 43 is located in this insertion phase in such a rotary angular position that its flattenings 69 are located at a side facing toward the pins 94. During subsequent rotation of the withdrawing pin 43 about 180° a fixation of the punch 22, the stripper 31 and the matrix shoe 39 in a horizontal plane relative to the tool exchange arrangement is obtained, so that later a withdrawal of this tool set from the revolving plates 1 and 2 is possible without manual operations.

The insertion of a tool set is performed in the reversed manner. By the withdrawing pins 43 and 46 on which the tool set is located it is displaced into the respective recesses of the revolving plates 1 and 2. The punch 22 is moved into the rectangular groove 49, the stripper 31 is moved into the groove 32, whereas the matrix shoe 39 is moved on the mounting plate 38 so far until its semicircular recess engage in the region of the flattening 65 the head of the safety pin 64 and the stripper shoe is arrested in this manner in this direction. During insertion of the stripper 31 the catch 93 must be released which must be performed simultaneously with its insertion.

The holding screw 29 of the punch holder 6 is located during this insertion phase of the tool set in the screwed-out position so that the centering pin 16 is also withdrawn, or in other words, is completely located inside the opening 54 of the punch holder 6. Subsequently, by actuation of the screwing tool 73, the holding screw 12 is screwed into the threaded opening 24 of the punch 22 whereby the entraining piece 50 is pressed downwardly and the spring 15 is compressed. The displacement of the entraining piece 50 results in a compression of the spring 17 and respective displacement of the centering pin 16, so that the latter penetrates into the opening 25 of the punch 22 and arrests the same. After the catch 68 also takes care of its catching function, and the clamping pin 26 is rotated by 180° by the coupling pin 86 and the rotary aggregate 85 so that their recesses 76 are no longer located at the side facing away from the semicircular recesses 78 of the matrix shoe 39, the tool set is completely arrested in the respective holders of the revolving plates 1 and 2.

Subsequently, by rotation of the withdrawing pin 43 by 180° its locking groove 70 is withdrawn from the region of the pin 94 so that the withdrawing pins 46, 43 can be subsequently withdrawn.

The inventive revolving cutting press is therefore characterized by a tool receiving system which makes possible a complete withdrawal of a complete tool set in substantially radial direction to the revolving plates 1 and 2, whereby the conditions are provided for cooperation with a computer-controlled tool exchange arrangement.

Reference letter A in FIGS. 6–8 identifies the identical distances of the openings 36 (FIG. 2) or the pins 94 from the outer limiting surfaces 95 of the punch 22, the stripper 31 and the matrix shoe 39.

It will be understood that each of the elements described above, or two or more together, may also find a useful application in other types of constructions differing from the types described above.

While the invention has been illustrated and described as embodied in a power tool, particularly a revolving cutting press with a tool receiving device suitable for a remotedly controlled exchange, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A power tool for working plate-shaped workpieces, particularly a revolving cutting press, comprising revolving plates arrestable in predetermined positions and receiving a plurality of tool sets each including at least one punch, stripper, and matrix; a plurality of receiving devices, said plurality of receiving devices including receiving device arranged to receive the matrix and being open in direction of withdrawl and insertion of the stripper and the matrix, respectively, said plurality of receiving deivces also including a receiving device arranged to receive the punch and being open in direction of withdrawal and insertion of the punch, said plurality of receiving devices being formed so that the punch, the stripper, and the matrix are directly withdrawable from and insertable into device arranged rectilinearily in a lateral direction which defines said withdrawal and insertion direction; a plurality of locking elements arranged to hold the punch, the stripper and the matrix in said receiving devices respectively, and actuatable independently of one another; and a plurality of individually switchable motor-driven actuating devices for releasing and arresting said locking elements of the punch, the stripper and the matrix respectively, and arranged near said revolving plates, the receiving device for the punch being formed as a punch holder, and the receiving device for the stripper being formed as a stripper shoe.

2. A power tool as defined in claim 1, wherein the revolving cutting press has a machine frame, said individually switchable actuating devices being mounted on the machine frame.

3. A power tool as defined in claim 1, wherein said punch holder has a lower region which faces toward the punch and is provided with a groove form-lockingly securing the punch relative to its working direction.

4. A power tool as defined in claim 1, wherein the punch has an opening, the locking element cooperating with the punch being composed of at least one centering pin which is bringeable in engagement with said opening of the punch and is guided inside the receiving device of the punch.

5. A power tool as defined in claim 4, wherein said punch holder is provided with an opening, said centering pin being guided in said opening of said punch holder.

6. A power tool as defined in claim 5, wherein the punch has a threaded opening, said centering pin being insertable into said opening of said punch for locking the latter, via an entraining piece slidingly guided inside said punch holder and by a holding screw arranged at a distance from the centering pin and screwable into said threaded opening of said punch.

7. A power tool as defined in claim 6; and further comprising a spring arranged between said entraining piece and said punch holder so that it is compressed by screwing of said holding screw into said threaded opening and with releasing of said holding screw said entraining piece is displaced relative to said punch holder.

8. A power tool as defined in claim 6, wherein said pin has a flange; and further comprising a further spring which is arranged between said punch holder and said flange, said flange abutting against one side of said entraining piece so that when said holding screw is screwed in, said centering pin is inserted into said opening of the punch via said entraining piece and said flange with compression of said further spring.

9. A power tool as defined in claim 6, wherein said holding screw is provided with a head which forms a coupling element for one of said actuating devices.

10. A power tool as defined in claim 9, wherein the actuating device cooperating with said head of said holding screw formed as a coupling element is formed as a rotary element motor driven in direction toward said head and arranged to be coupled with said head.

11. A power tool as defined in claim 10, wherein said actuating device cooperating with said head of said holding screw is formed as a screwing tool.

12. A power tool as defined in claim 1, wherein the locking elements cooperating with the matrix include a safety pin and two clamping pins, said clamping pins being arranged at both sides relative to the direction of insertion or withdrawal of the matrix, said clamping pins being arranged movable for providing with the matrix a form-locking connection such that the matrix both relative to the direction of its withdrawal or insertion and also in a direction normal to said first-mentioned direction is fixed, said safety pin substantially forming an abutment point.

13. A power tool as defined in claim 12, wherein said clamping pins are supported rotatable about their longitudinal axes.

14. A power tool as defined in claim 12, wherein said clamping pins have heads and are provided at their upper regions facing toward the matrix with a recess located under the respective head, so that the clamping pins in the region of said recess having a portion with a shape of a circular segment, said matrix being provided with a matrix shoe which carries the matrix, at least one of said matrix and matrix shoe which carries the matrix being provided with openings having an approximately semi-circular shape with the same radius as said portion, and said portion of said clamping pins engaging in an arresting position of said clamping pins into recesses of at least one of said matrix and said matrix shoe whereas in an open position of said clamping pins said portion is located at a side opposite to said recess of at least one of said matrix and said matrix shoe so that no engagement between said clamping pins and said openings of at least one of said matrix and said matrix shoe takes place.

15. A power tool as defined in claim 12, wherein said clamping pins are provided at its end facing away from the matrix with a coupling element for one of said actuating devices formed as a structural part.

16. A power tool as defined in claim 15, wherein each structural element of both clamping pins associated with one matrix is connectable with a rotary drive motor driven in direction to said structural elements.

17. A power tool as defined in claim 1, wherein the locking element cooperating with the stripper is formed as a spring-loaded catch.

18. A power tool as defined in claim 1, wherein the punch, the stripper and the matrix are each provided with two pairs of openings, the openings of one of said pairs being arranged at a distance from one another and extending in direction of the withdrawal and insertion, each of the openings of said one pair having an edge region, the openings of the other pair extending normally to the openings of said one pair, each of the openings of said other pair intersecting a respective opening of said one pair in the edge region, the respective tool having an outer limiting surface; and further comprising a pin inserted in each of said openings of said other pair so that said pin partially extends into the openings of said one pair, and said openings of said other pair being arranged at a distance from said outer limiting surface of the respective tool.

19. A power tool as defined in claim 1, wherein the receiving device for the matrix is formed as a mounting plate.

* * * * *